US006975222B2

(12) United States Patent
Krishan et al.

(10) Patent No.: US 6,975,222 B2
(45) Date of Patent: Dec. 13, 2005

(54) ASSET TRACKING APPARATUS AND METHOD

(75) Inventors: Baldev Krishan, 1450 Washo Dr., Fremont, CA (US) 94539; Benjamin K. Yee, Fremont, CA (US); Huey K. Lee, Fremont, CA (US)

(73) Assignee: Baldev Krishan, Fremont, CA (US)

( * ) Notice: Subject to any disclaimer, the term of this patent is extended or adjusted under 35 U.S.C. 154(b) by 1 day.

(21) Appl. No.: 10/394,806

(22) Filed: Mar. 21, 2003

(65) Prior Publication Data

US 2004/0183672 A1 Sep. 23, 2004

(51) Int. Cl.[7] ..... G08B 1/08

(52) U.S. Cl. ..... 340/539.13; 340/573.1; 340/539.1; 340/539.11; 340/539.15; 340/539.31; 340/539.32

(58) Field of Search ..... 340/573.1, 539.1, 340/539.11, 539.13, 539.15, 539.31, 539.32

(56) References Cited

U.S. PATENT DOCUMENTS 5,652,570 A * 7/1997 Lepkofker ..... 340/573.4
5,742,233 A * 4/1998 Hoffman et al. ..... 340/573.1
6,225,901 B1 * 5/2001 Kail, IV ..... 340/539.11

OTHER PUBLICATIONS

N.F. Krasner, G. Marshall, and W. Riley; Position Determination Using Hybrid GPS/Cellphone Ranging; http://www.snaptrack.com/AtWork/ion2002_pos_determination; 2002; 12 pages.

Z. Biacs, G. Marshall, M. Moeglein, and W. Riley; The Qualcomm/SnapTrack Wireless-Assisted GPS Hybrid Positioning System and Results from Initial Commercial Deployments http://www.snaptrack.com/AtWork/ion2002_qualcomm_hybrid_agps; 2002; 7 pages.

Goran M. Djuknic and Robert E. Richton; Geolocation and Assisted-GPS http://www.lucent.com/livelink/090094038000e51f_White_paper; 2002; 10 pages.

* cited by examiner

*Primary Examiner*—Daryl C. Pope
(74) *Attorney, Agent, or Firm*—Manatt Phelps & Phillips

(57) ABSTRACT

An asset securing and tracking system (30) operates in conjunction with a wireless communication network (65) for tracking a portable asset (35). The system (30) includes a tracking device (31) adapted to be attached to the portable asset (35) and communicate with the wireless communication network (65). The tracking device (31) determines the location of the asset (35) using signals from GPS satellites (55) and the terrestrial wireless communication network (65). A monitoring station (32) receives and processes a location signal regarding the geographic location of the portable asset (35) from tracking device (31) via the wireless communication network (65).

5 Claims, 4 Drawing Sheets

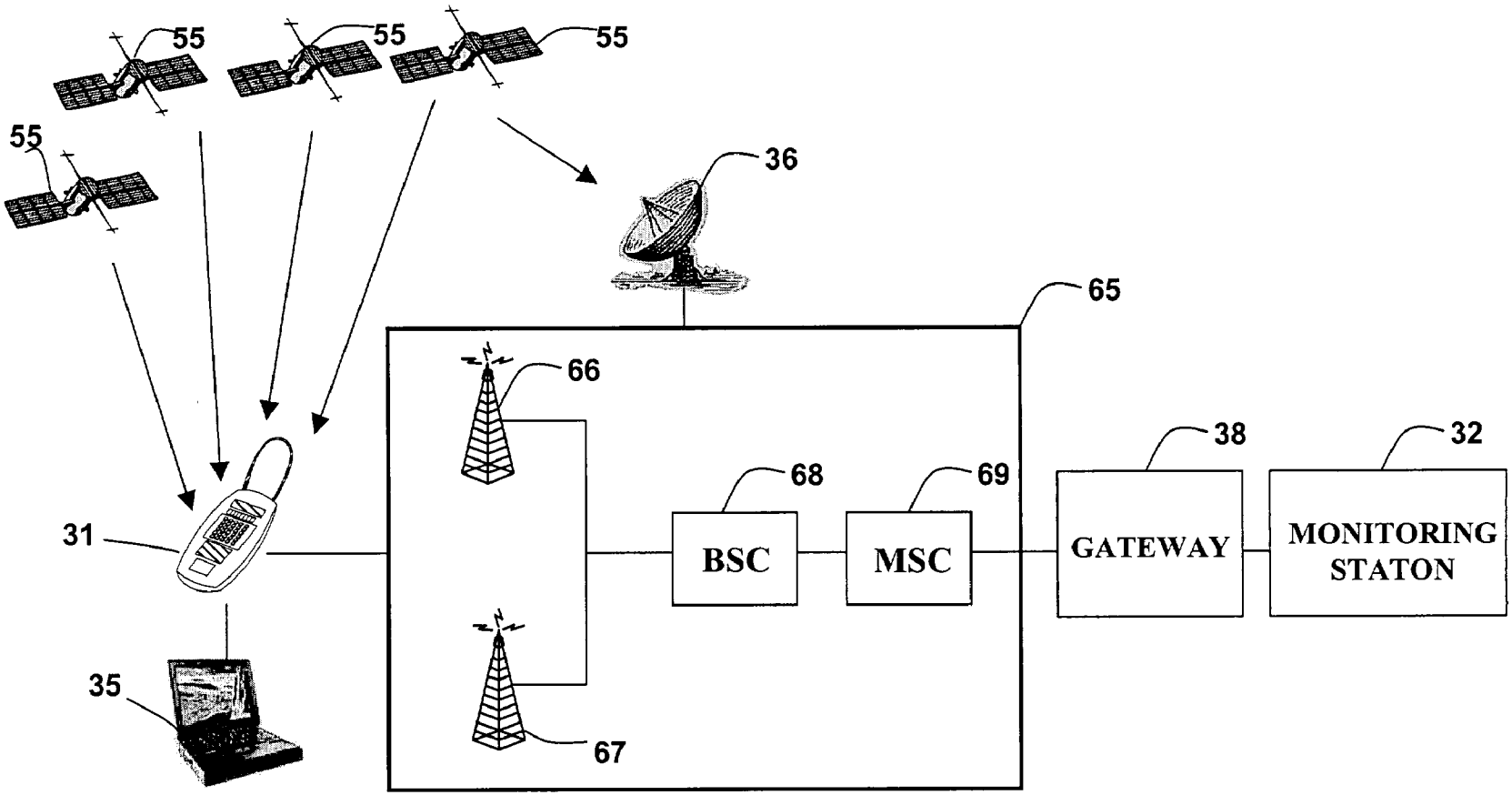
30 FIG. 3

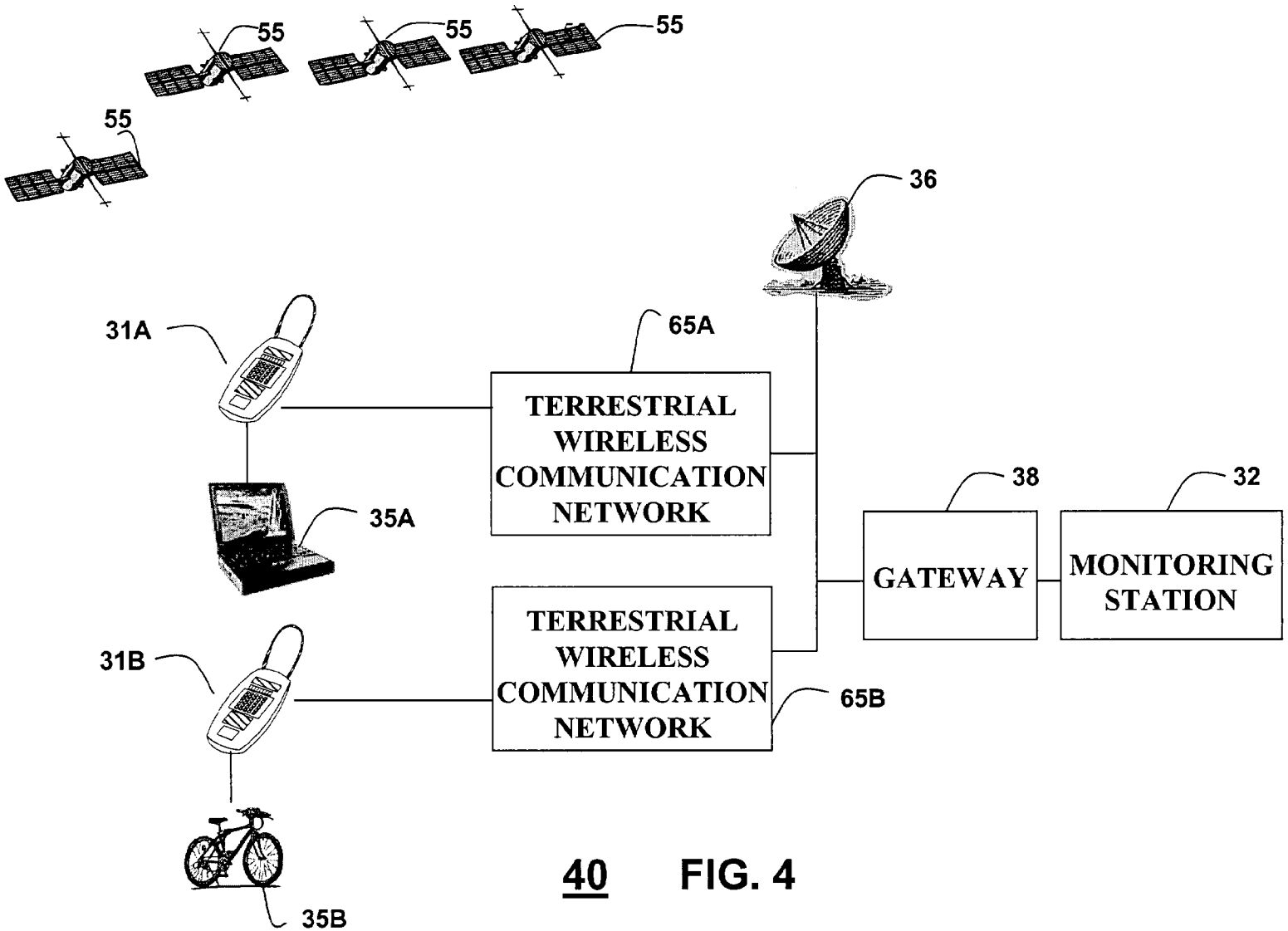
40 FIG. 4

ASSET TRACKING APPARATUS AND METHOD

FIELD OF THE INVENTION

The present invention relates, in general, to asset tracking and, more specifically, to device and method for securing and tracking a portable object.

BACKGROUNDS OF THE INVENTION

In our fast paced and highly mobile society, people increasingly rely on portable electronics equipment, for example, laptop computers, personal digital assistants (PDA), personal communication system (PCS) devices, etc. to improve their productivity or enrich their lives. However, people often lose portable electronics equipment due to theft or misplacement. The cost of losing portable equipment includes not only the replacement cost of the hardware and the software installed thereon, but also the loss of the data stored in the equipment and the loss of productivity.

Cable locks are often used for securing laptop computers to fixed items to deter theft. Cable locks are simple to use and relatively inexpensive. However, the cables can be cut or sheared by a determined larcenist. Furthermore, once a portable asset is stolen or otherwise lost, it is nearly impossible for the owner to track and retrieve it.

Accordingly, it would be advantageous to have an apparatus and method for effectively securing portable objects. It would be beneficial for the apparatus to be able to be securely attached to the portable object. It would be beneficial for the apparatus and the method to be able to track the portable object over a large geographic area and under a variety of conditions. Further, would be beneficial to generate an alarm signal when the portable object is not in the possession of its owner.

BRIEF DESCRIPTION OF THE DRAWINGS

FIG. 3 is a schematic diagram illustrating an asset tracking system in accordance with the present invention; and FIG. 4 is a schematic diagram showing another asset tracking system in accordance with the present invention.

DETAILED DESCRIPTION OF VARIOUS EMBODIMENTS

Figure 1:
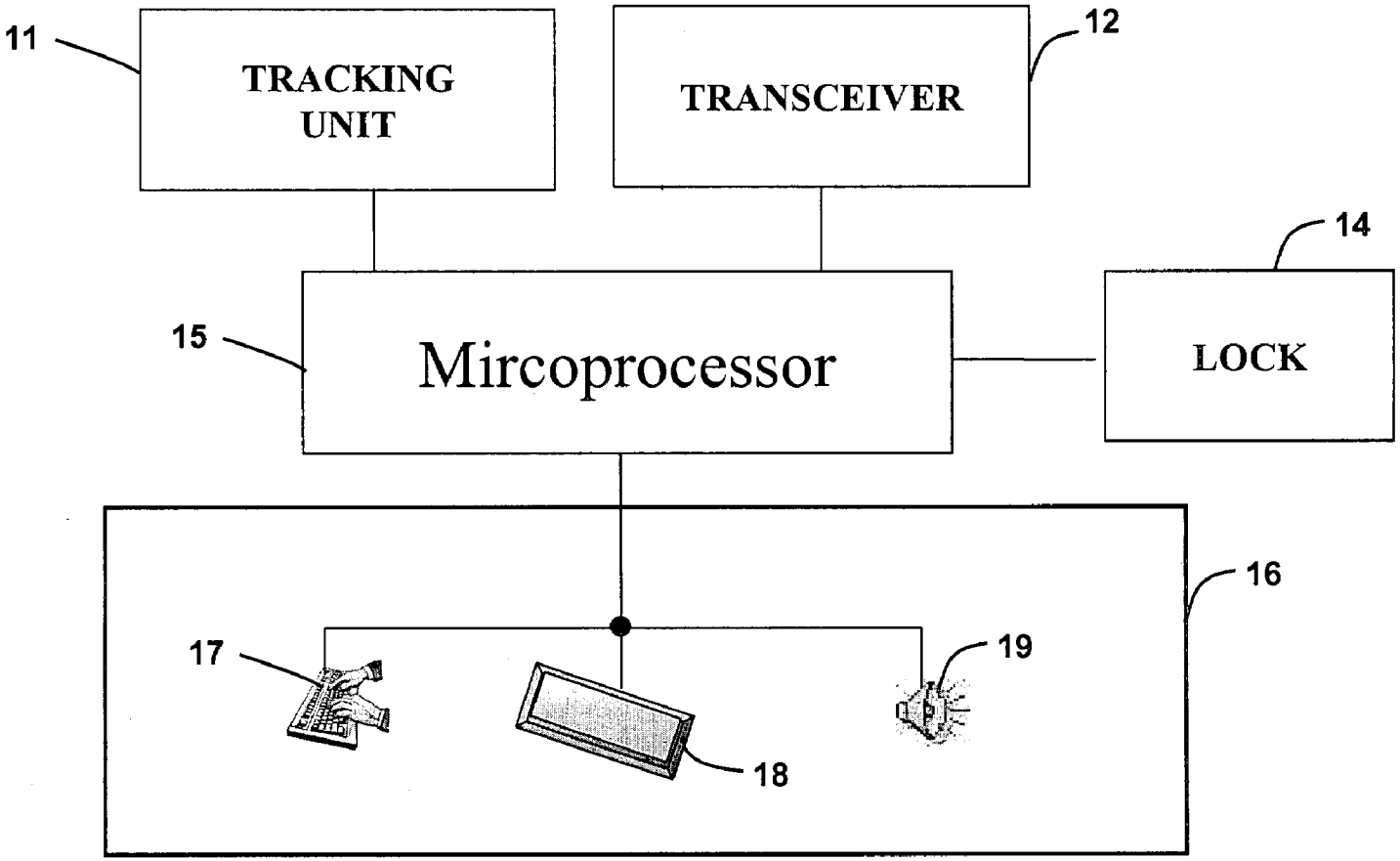
FIG. 1 is a functional block diagram illustrating an apparatus for securing and tracking an object in accordance with the present invention.

Various embodiments of the present invention are described hereinafter with reference to the figures. Elements of like structures or function are represented with like reference numerals throughout the figures. The figures are only intended to facilitate the description of specific embodiments of the invention. They are not intended as an exhaustive description of the invention or as a limitation on the scope of the invention. In addition, an aspect described in conjunction with a particular embodiment of the present invention is not necessarily limited to that embodiment and can be practiced in conjunction with any other embodiments of the invention.

FIG. 1 is a functional block diagram illustrating an apparatus 10 in accordance with an embodiment of the present invention. Apparatus 10 is used for securing and tracking an object (not shown in FIG. 1) such as a computer, a camera, a camcorder, a bicycle, a scooter, a motorcycle, a piece of luggage, a handbag, a backpack, etc. Apparatus 10 can also be referred to as an asset securing device, an asset tracking device, an electronic locking device, etc.

In this embodiment, apparatus 10 includes a tracking unit 11 and a radio frequency (RF) transceiver 12 coupled to a signal processor 15. Tracking unit 11, which is also referred to as a tracking device, a geographic positioning device, etc., includes a global positioning system (GPS) receiver to determine the geographic location of the object using signals from the GPS satellites. In a preferred embodiment the GPS receiver includes a wireless assisted GPS (AGPS) device, and signal processor 15 includes a microprocessor. RF transceiver 12 may be an element of tracking unit 11. Apparatus 10 also includes user interface 16 coupled to microprocessor 15. FIG. 1 shows interface 16 including a keypad 17, a visual display 18, and an audio alarm 19.

In accordance with one embodiment of the present invention, apparatus 10 includes a lock 14 configured to securely attach apparatus 10 to the object to be tracked. In this embodiment, apparatus 10 also includes a frame, a casing, or an enclosure (not shown in FIG. 1) mechanically coupled to lock 14 for holding different components of apparatus 10 together. In accordance with the present invention, lock 14 can have various types locking/unlocking mechanisms, e.g., mechanical, optical, magnetic, electrical, etc. In one embodiment, lock 14 includes a cable made of a sturdy material, such as metal, hard plastic, or fibers that are capable of securing the object to another item. In another embodiment, lock 14 is an electronic lock coupled to microprocessor 15. Microprocessor 15 controls the operation of electronic lock 14 in response to signals from interface 16 or from a remote monitoring station (not shown in FIG. 1).

In accordance with another embodiment of the present invention, apparatus 10 is embedded in the object to be tracked. The object, e.g., a portable computer, with apparatus 10 embedded therein, is capable of tracking its own geographic location. In one embodiment, the elements of apparatus 10 are embedded directly into the object. In another embodiment, apparatus 10 includes a structure, e.g., a frame or a case, (not shown in FIG. 1) that holds the elements in apparatus 10 together. The structure is attached to the object. This allows apparatus 10 to be easily detached from the object, which may be desirable in certain circumstances and applications, e.g., detaching apparatus 10 from the object for maintenance, for upgrading, for attaching to another object for tracking, etc.

With apparatus 10 embedded in the object, some elements in apparatus 10 may serve multiple functions. By way of example, microprocessor 15 may also serve as a microprocessor of a computer to be tracked using apparatus 10. Also by way of the example, radio frequency transceiver 12 may also serve as a wireless modem of the computer or share the same antenna with the wireless modem of the computer. Sharing the functional elements between apparatus 10 and the tracked object improves the overall cost efficiency of the object.

FIG. 1 shows interface 16 including keypad 17, visual display 18, and audio alarm 19. They serve to establish a communication link between a user and microprocessor 15. For example, the user may enter user commands or security codes into microprocessor 15 through keypad 17. Visual display 18 may display the status of apparatus 10, e.g., whether lock 14 is in a lock position or an unlock position, whether the user entered commands or security codes are valid, whether apparatus 10 is within the coverage area of a terrestrial wireless communication network, whether the battery (not shown in FIG. 1) needs recharging, etc. Audio alarm 19 may be activated by microprocessor 15 when the object is not in the possession of its owner. For example, microprocessor 15 may activate audio alarm 19 when an invalid security code is entered at keypad 17. Microprocessor 15 may also activate audio alarm 19 in response to a command from a monitoring station (not shown in FIG. 1).

It should be understood that interface 16 is optional in accordance with the present invention. Furthermore, interface 16 is not limited to including keypad 17, visual display 18, and audio alarm 19, as shown in FIG. 1. In accordance with an alternative embodiment of the present invention, apparatus 10 is embedded in the object to be tracked and invisible from the exterior of the object. In this embodiment, apparatus 10 does not include keypad 17 and visual display 18. Alternatively, apparatus 10 may use the interface of the tracked object, e.g., the keyboard, visual display, and the sound system of a portable computer, as its interface 16. In another alternative embodiment, interface 16 may include a pattern recognition device (not shown in FIG. 1) in addition to or in place of keypad 17. The pattern recognition device may recognize the fingerprint and/or the eye pupil pattern of the owner. In yet another alternative embodiment, interface 16 includes a writing pad (not shown in FIG. 1) for handwriting. In yet another alternative embodiment, interface 16 includes a thumbwheel (not shown in FIG. 1) input.

Figure 2:
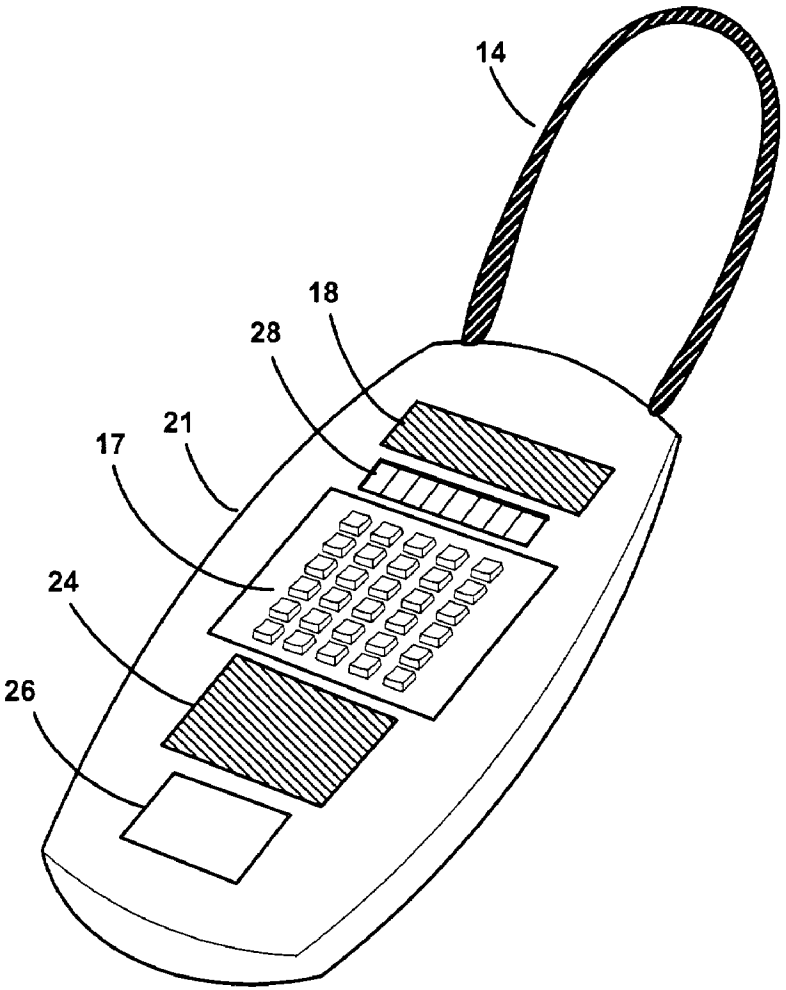
FIG. 2 shows a perspective view of an asset securing and tracking device in accordance with the present invention.

FIG. 2 illustrates a perspective view of a portable asset securing and tracking device 20 in accordance with the present invention. In accordance with a preferred embodiment, asset securing and tracking device 20 is functional similar to apparatus 10 described herein above with reference to FIG. 1. Device 20 has a hard casing holding and enclosing various functional components, e.g., tracking unit 11, transceiver 12, and microprocessor 15 as shown in FIG. 1. In a preferred embodiment, casing 21 is water proof and shock proof, thereby protection the functional components therein from potential hazardous environment and tampering.

A lock 14 is mechanically coupled to casing 21 for attaching device 20 to the object to be secured or tracked. FIG. 2 shows lock 14 as a steel cable lock in accordance with an embodiment of the present invention. Cable lock 14 is capable of attaching device 20 to more than one objects simultaneously. Cable lock 14 is also capable of securing the object to a fixed item, e.g., a bicycle rack. Lock 14 may be opened and closed using a key, which may be mechanical, optical, magnetic, electrical, etc. Lock 14 may also be operated in response to the commands from microprocessor 15.

Device 20 also includes an alpha numeric keypad 17 and a liquid crystal display (LCD) panel 18 on the surface of casing 21, which are parts of interface 16 described above with reference to FIG. 1. FIG. 2 shows that interface 16 also includes a finger print identification faceplate 24. Faceplate 24 is coupled to microprocessor 15 (shown in FIG. 1) for verifying the identity of the person who seeks to operate device 20, e.g., unlocking lock 14, deactivating the tracking function, turning off the audio alarm, etc. If the finger print read through faceplate 24 does not match that of the owner, device enters a security mode. In the security mode, device 20 rejects any further input from the user until a valid finger print identification is provided. Device 20 further performs various functions to secure the object, which functions include, but are not limited to, sending out location signals indicating the location of the object, activating the audio alarm, etc.

Device 20 also includes a battery compartment 26 and a solar panel 28. Battery compartment 26 encloses a power source for operating device 20. Solar panel 28 functions to recharge the power source in battery compartment 26. In accordance with a preferred embodiment, battery compartment 26 includes a tampering proof cover, thereby avoiding device 20 being deactivated by an unauthorized user.

It should be noted that solar panel 28 is an optional feature in device 20. In an alternative embodiment, device 20 includes a power source recharging adapter, in addition to or in place of solar panel 28, for recharging the power source. In yet another alternative embodiment, the power source in device 20 includes a non-rechargeable high energy density battery, e.g., a lithium battery, which can be replaced.

FIG. 3 is a schematic diagram illustrating an asset securing and tracking system 30 in accordance with an embodiment of the present invention. System 30 operates in conjunction with a wireless communication network 65 for tracking a portable asset or object 35. By way of example, FIG. 3 shows object 35 as a portable computer.

Asset securing and tracking system 30 includes a tracking device 31 configured to be attached to object 35 for tracking object 35. In accordance with a preferred embodiment of the present invention, tracking device 31, which is also referred to as an asset tracking unit or an asset securing apparatus, is functionally similar to apparatus 10 described herein above with reference to FIG. 1. Asset securing and tracking system 30 also includes a monitoring station 32 that monitors and tracks the geographic location of object 35. Specifically, monitoring station 32 sends a tracking command to tracking device 31 via wireless communication network 65 and receives a location signal indicating the geographic location of object 35 from tracking device 31 via wireless communication network 65.

In accordance with a preferred embodiment of the present invention, tracking device 31 includes a GPS or an AGPS device that is functionally similar that described herein above with reference to tracking unit 11 shown in FIG. 1. Using GPS and AGPS to determine the geographic location of an object are described in "Geolocation and Assisted-GPS" by Goran M. Djuknic and Robert E. Richton, published on May 31, 2002 on line at the web page http://www.lucent.com/livelink/090094038000e51f_White_paper.pdf, which is incorporated herein by reference in its entirety.

A GPS receiver in tracking device 31 determines the geographic location of object 35 using signals from GPS satellites 55. The GPS includes a constellation of twenty-four satellites for providing coded signal coverage throughout the world at a frequency of 1574.42 mega-Hertz (MHz). The GPS receiver in tracking device 31 receives and processes the coded signals from at least four GPS satellites to determine the location of object 35 (longitude, latitude, and altitude). However, the GPS receiver cannot effectively determine the location when tracking device 31 is not in the direct lines of sight from the GPS satellites. This may happen when tracking device 31 is indoors, surrounded by high rise buildings, or under a canopy of trees.

An AGPS device uses signals from GPS satellites 55 and signals from base stations, e.g., base stations 66 and 67 shown in FIG. 3, in terrestrial wireless communication network 65, in determining the geographic location of tracking device 31. When tracking device 31 is in the lines of sight of the GPS satellites, it uses signals from both GPS satellites 55 and base station 66 or 67 to calculate its location. This will generally increase the accuracy of tracking device 31. In addition, the AGPS device is capable of determining the location of tracking device 31 even when it is not in the lines of sight from GPS satellites 55 by processing the signals from base station 66 or 67.

Terrestrial wireless communication network 65 may be any kind of wireless communication network. For example, network 65 may be a network dedicated for asset tracking purpose. In a preferred embodiment, network 65 is an existing cellular telephone network that provides coverage over a wide geographic area. A cellular telephone network typically includes base station controllers (BSC), e.g., a BSC 68 shown in FIG. 3, and mobile switching centers (MSC), e.g., a MSC 69 shown in FIG. 3. BSC 68 and MSC 69 serve to establish communication between tracking device 31 and different base stations 66 depending on the location of tracking device 31 in the cellular network 65. Furthermore, network 65 may employ various kinds of multiple access standards for the multiple access of network 65, e.g., time division multiple access (TDMA), frequency division multiple access (FDMA), code division multiple access (CDMA), a combination of different multiple access standards, etc.

In an embodiment with asset tracking device 31 including an AGPS device, asset tracking system 30 also includes an AGPS server 36 communicating with wireless communication network 65. AGPS server 36 functions to generate coded positioning signals of base stations 66 and 67 in wireless communication network 65 in accordance with the signals from GPS satellites 55. In other words, AGPS server 36 synchronizes the coded positioning signals of base stations 66 and 67 in terrestrial wireless communication network 65 with the signals of GPS satellites 55. In accordance with one embodiment of the present invention, AGPS server 36 is stationary and is locked to the signals from a predetermined set of GPS satellites. In accordance with another embodiment of the present invention, AGPS server 36 selectively locks onto the signals from the GPS satellites for optimal signal transmission quality.

Asset tracking system 30 further includes a network gateway 38 coupled to monitoring station 32. Network gateway 38 serves to relay the signals between monitoring station 32 and wireless communication network 65. The signal transmission between gateway 38 and wireless communication network 65 can be either wired or wireless in accordance with the present invention. It should be noted that network gateway 36 is optional in accordance with the present invention. Furthermore, network gateway 38 is not limited to being an element in asset tracking system 30 separate from monitoring station 32. In accordance with an alternative embodiment of the present invention, network gateway 38 is an integral part of monitoring station 32.

In operation according to an embodiment of the present invention, tracking device 31 tracks the geographic location of object 35 using signals from GPS satellites 55 and terrestrial wireless communication network 65. In one embodiment, tracking device 31 periodically sends out location signals indicating the location of object 35. Monitoring station 32 receives the location signals via wireless communication network 65 and network gateway 38, thereby tracking the geographic location of object 35. In another embodiment, tracking device 31 transmits the location signal in response to a tracking command from monitoring station 32 transmitted through wireless communication network 65. Monitoring station 32 may periodically send out the tracking commands to keep tracking object 35. Monitoring station 32 may also send out the tracking command in response to the owner of object 35 reporting the loss of object 35. After receiving the location signal from tracking device 31, monitoring station 32 may direct the owner or the law enforcement authority to object 35.

FIG. 4 is a schematic diagram illustrating an asset tracking system 40 in accordance with another embodiment of the invention. System 40 operates in conjunction with multiple wireless communication networks for asset tracking. By way of example, FIG. 4 shows asset tracking system 40 operating with two terrestrial wireless communication networks 65A and 65B.

Asset securing and tracking system 40 includes a tracking device 31A configured to be attached to an object 35A for tracking object 35A, and a tracking device 31B configured to be attached to an object 35B for tracking object 35B. In accordance with a preferred embodiment of the present invention, tracking devices 31A and 31B are functionally similar to apparatus 10 described herein above with reference to FIG. 1. Asset securing and tracking system 40 also includes a monitoring station 32 that monitors and tracks the geographic locations of objects 35A and 35B. Specifically, monitoring station 32 receives location signals indicating the geographic locations of objects 35A and 35B from tracking devices 31A and 31B, respectively, via at least one of wireless communication networks 65A and 65B.

Asset tracking system 40 further includes a network gateway 38 serving to relay the signals between monitoring station 32 and wireless communication networks 65A and 65B. The signal transmission between gateway 38 and wireless communication networks 65A and 65B can be either wired or wireless in accordance with the present invention.

In accordance with a preferred embodiment of the present invention, each of tracking devices 31A and 31B includes a GPS or an AGPS device that is functionally similar to that described herein above with reference to tracking unit 11 shown in FIG. 1. If at least one of tracking devices 31A and 31B is an AGPS device, asset tracking system 40 also includes an AGPS server 36 communicating with at least one of wireless communication networks 65A and 65B. AGPS server 36 functions to generate the coded positioning signals in at least one of wireless communication networks 65A and 65B in accordance with the signals from GPS satellites 55. In other words, AGPS server 36 synchronizes the coded positioning signals of at least one of terrestrial wireless communication networks 65A and 65B with the signals of GPS satellites 55. In accordance with one embodiment of the present invention, AGPS server 36 is locked to the signals from a predetermined set of GPS satellites. In accordance with another embodiment of the present invention, AGPS server 36 selectively locks onto the signals from the GPS satellites for optimal signal transmission quality.

By way of example, FIG. 4 shows asset tracking devices 31A and 31B communicating with monitoring station 32 via networks 65A and 65B, respectively. Furthermore, asset tracking devices 31A and 31B receive coded signals from networks 65A and 65B, respectively, in determining the locations of respective objects 35A and 35B. Also by way of example, wireless communication networks 65A and 65B are wireless networks operated by different wireless service providers.

Generally, different service providers operate wireless communication networks covering different areas, having different communication standards, e.g., TDMA, CDMA, global system for mobile communication (GSM), etc., operating at different frequency bands, e.g., 800 MHz, 1900 MHz, etc., or having different bandwidths and data transmission rates. In accordance with an embodiment of the present invention, asset tracking system 40 is operated in conjunction with multiple wireless communication networks to provide asset tracking over a wide geographic area. Asset tracking devices 31A and 31B may be single mode devices compatible with a particular network or multiple mode devices compatible with more than one wireless communication networks.

The operation of asset tracking system 40 in securing and tracking objects 35A and 35B is similar to those described herein above with reference to FIGS. 1 and 3. It should be understood that although FIG. 4 shows asset tracking system 40 including two asset tracking devices, 31A and 31B, and operating in conjunction with two terrestrial wireless communication networks, 65A and 65B, this is not intended as a limitation on scope of the present invention. In accordance with the present invention, asset tracking system 40 may include one or many tracking devices for securing and tracking a single or multiple objects. The total number of tracking devices simultaneously operating in asset tracking system 40 may be limited by the data processing capacity of monitoring station 32 and data transmission capacity of network gateway 38. Furthermore, asset tracking system 40 may operate in conjunction with any number of wireless communication networks. In addition, different terrestrial wireless communication networks, 65A and 65B, may receive the GPS satellite synchronizing signals from one AGPS server 36, or may receive the synchronizing signals from different AGPS servers.

An apparatus and method for tracking portable objects has been provided. In accordance with the present invention, a tracking device is attached to the object to be secured or tracked. The tracking device tracks the location of the object using coded signals for the GPS satellites. Optionally, the tracking device further uses the coded signals from a terrestrial wireless communication network in determining the location of the tracked object. A monitoring station communicates with the tracking device via the terrestrial wireless communication network and receives the location signals transmitted from the tracking device.

The application of tracking objects is not limited to securing portable assets. The asset tracking apparatus and process in accordance with the present invention are applicable in any area where tracking the location of an object is desirable, e.g., in the areas of cargo transportation and package delivery. In addition, the tracking device and process in accordance with the present invention are also applicable in tracking animals or even humans. For example, law enforcement authority may use the tracking system of the present invention in tracking people released on bond or on parole. Many other modifications may be made by those skilled in the art after browsing the specification without departing from the spirit and scope of the invention.

While the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention. The present invention is limited only by the claims that follow.

What is claimed is:

1. An apparatus for tracking an object, comprising:

a geographic positioning device;

a radio frequency transceiver;

a signal processor coupled to said geographic positioning device and to said radio frequency transceiver, said signal processor being programmed to broadcast a location signal indicating a geographic location of the object determined by said geographic positioning device through said radio frequency transceiver; and a lock for securing the apparatus to the object, wherein said geographic positioning device, said radio frequency transceiver, said signal processor, and said lock are embedded in the object.

2. An apparatus for tracking an object, comprising:

a geographic positioning device configured to be attached to the object;

a radio frequency transceiver;

a signal processor coupled to said geographic positioning device and to said radio frequency transceiver, said signal processor being programmed to broadcast a location signal indicating a geographic location of the object determined by said geographic positioning device through said radio frequency transceiver;

a lock for securing the apparatus to the object; and a frame holding said geographic positioning device, said radio frequency transceiver, and said signal processor, said frame being adapted for being secured to the object with the lock, wherein said frame is attached to an interior of to the object.

3. An apparatus for tracking an object, comprising:

a geographic positioning device configured to be attached to the object;

a radio frequency transceiver;

a signal processor coupled to said geographic positioning device and to said radio frequency transceiver, said signal processor being programmed to broadcast a location signal indicating a geographic location of the object determined by said geographic positioning device through said radio frequency transceiver;

a lock for securing the apparatus to the object; and a frame holding said geographic positioning device, said radio frequency transceiver, and said signal processor, said frame being adapted for being secured to the object with the lock, wherein said lock is configured to removably attach said frame to the object.

4. An apparatus for tracking an object, comprising:

a geographic positioning device configured to be attached to the object;

a radio frequency transceiver;

a signal processor coupled to said geographic positioning device and to said radio frequency transceiver, said signal processor being programmed to broadcast a location signal indicating a geographic location of the object determined by said geographic positioning device through said radio frequency transceiver;

a lock for securing the apparatus to the object; and a user interface coupled to said signal processor, wherein said user interface includes a pattern recognition device.

5. A method for tracking a portable object, comprising:

embedding a tracking device in the portable object;

tracking a location of the portable object using a first plurality of signals from a plurality of global positioning system (GPS) satellites;

transmitting a location signal indicating the location of the portable object; and receiving and processing the location signal at a monitoring station.

* * * * *